US010934036B2

(12) United States Patent
Nowaczyk

(10) Patent No.: US 10,934,036 B2
(45) Date of Patent: Mar. 2, 2021

(54) APPARATUS AND METHOD FOR DISTRIBUTING A FLUSHING GAS

(71) Applicant: David Nowaczyk, Naperville, IL (US)

(72) Inventor: David Nowaczyk, Naperville, IL (US)

( * ) Notice: Subject to any disclaimer, the term of this patent is extended or adjusted under 35 U.S.C. 154(b) by 0 days.

(21) Appl. No.: 16/400,028

(22) Filed: Apr. 30, 2019

(65) Prior Publication Data

US 2020/0115078 A1 Apr. 16, 2020

Related U.S. Application Data

(60) Provisional application No. 62/665,022, filed on May 1, 2018.

(51) Int. Cl.
*B65B 31/04* (2006.01)

(52) U.S. Cl.
CPC ..... *B65B 31/041* (2013.01)

(58) Field of Classification Search
CPC ..... B65B 31/041; B65B 31/00; F26B 21/00; F28D 2021/0042; F28F 9/0221
See application file for complete search history.

(56) References Cited

U.S. PATENT DOCUMENTS 4,039,275 A 8/1977 McGettrick
4,140,159 A 2/1979 Domke
4,787,547 A 11/1988 Hella et al.
5,417,255 A 5/1995 Sanflippo et al.
5,911,249 A * 6/1999 Sanfilippo ..... B65B 31/041 141/11
5,961,000 A 10/1999 Sanflippo et al.
2006/0162290 A1 6/2006 Kakita et al.
2012/0279180 A1 11/2012 Crawford et al.
2014/0123599 A1 5/2014 Gustafsson et al.
2015/0307217 A1 10/2015 Fairbank et al.

OTHER PUBLICATIONS

Linde Gas, "The Ultimate Combination for Freshness. Mapax Modified Atmosphere Packaging", Promotional Information Brochure, Created Aug. 26, 2008 Per PDF "Properties", Publication Date is Unknown.

* cited by examiner

*Primary Examiner* — Jason K Niesz
(74) *Attorney, Agent, or Firm* — David A. Gottardo, Attorney at Law

(57) ABSTRACT

This invention relates generally to the distribution of a flushing gas during a packaging process. More specifically, the invention relates to an apparatus and method for the distribution of a flushing gas that displaces an undesirable gas from a packaging container during such a process, the apparatus and method optimizing the displacement of the undesirable gas within the container while also minimizing associated equipment costs and cleaning efforts.

20 Claims, 10 Drawing Sheets

APPARATUS AND METHOD FOR DISTRIBUTING A FLUSHING GAS

CROSS REFERENCE TO RELATED APPLICATIONS

This application claims priority to U.S. Provisional Patent Application Ser. No. 62/665,022 having a filing date of May 1, 2018.

TECHNICAL FIELD OF THE INVENTION

This invention relates generally to the distribution of a flushing gas during a packaging process. More specifically, the invention relates to an apparatus and method for the distribution of a flushing gas that displaces an undesirable gas from a packaging container during such a process, the apparatus and method optimizing the displacement of the undesirable gas within the container while also minimizing associated equipment costs and cleaning efforts.

BACKGROUND OF THE INVENTION

Various food products are packaged within containers such that the freshness of the product is controlled and maintained via a minimization of the product's exposure to undesirable, atmospheric gases. This is because undesirable, atmospheric gases, such as residual oxygen, typically do not inhibit the growth of mold or bacteria within the product, or inhibit the product's oxidation. For example, certain granular or particulate-form food products, such as ground coffee, are packaged and sealed within cans or similar containers preferably having the undesirable gases displaced there-from. Such gas displacement occurs during the packaging process whereas any undesirable gases located within the container, both prior to and after the product is placed therein, is displaced there-from by a more desirable flushing gas. Common flushing gases comprise carbon dioxide, for the inhibition of mold or bacterial growth, or nitrogen, for the inhibition of oxidation.

To facilitate the displacement of undesirable gases from food product containers during packaging operations, complications arise due to the laminar or turbulent flow properties associated with flushing processes. For example, a low velocity, laminar flow rate of flushing gases into an empty container, prior to placement of any food product therein, is generally insufficient to remove undesirable gases from the container. A low velocity flow of flushing gas into the container often allows pockets of undesirable gases to remain therein. Similarly, a high velocity, turbulent flow rate of flushing gases into a container having the product already placed therein, generally results in a disturbance of the product itself (i.e., an undesirable blowing of the granulated product from within the container).

Prior art flushing devices exist for providing both laminar and turbulent-flow flushing gases during packaging operations. For example, devices utilizing screen assemblies have been utilized for controlling the flow properties of flushing gases entering packaging containers.

However, such screen assemblies present numerous disadvantages within the prior art. For example, screen assemblies contaminate quickly and are difficult to clean, thus presenting increased maintenance and cleaning costs. Furthermore, screening assemblies often lack rigidity and thus require additional, rigidity-providing materials in their construction—again driving up costs. The present invention overcomes these disadvantages and provides numerous other advantages over the prior art.

SUMMARY OF THE INVENTION

This invention relates generally to the distribution of a flushing gas during a packaging process. More specifically, the invention relates to a plenum for the distribution of a flushing gas that displaces an undesirable gas from a packaging container during such a process, the plenum optimizing the displacement of the undesirable gas within the container while also minimizing associated equipment costs and cleaning efforts. A plenum is operably associated with a conveyor segment configured for moving a plurality of containers located thereon. Each container defines an open upper end and closed lower end to accommodate the placement of product within each container's interior. The plenum is preferably located proximal to and above the container's open upper ends such that the plenum can flush the containers' interiors with a flushing gas.

For a plenum configured to provide a turbulent flushing gas flow to the container, the plenum preferably comprises a longitudinal manifold defining a fillister and an inlet for receiving the flushing gas from a pressurized gas source, with the fillister defining an external perimeter flange. A longitudinal covering plate is in sealing abutment with the external perimeter flange to define a longitudinal duct for accommodating the flushing gas therein. The covering plate preferably defines a plurality of through slits that are in fluid communication with the duct. The slits are preferably oriented on an angle in relation to a longitudinal outer edge of the plate to both preserve the structural integrity of the plate and to minimize the occurrence of a container's upper end catching on a slit while carried there-under on the conveyor.

For a plenum configured to provide a laminar flushing gas flow to the container, the plenum preferably comprises a longitudinal manifold defining a stepped fillister and an inlet for receiving the flushing gas from a pressurized gas source, with the stepped fillister defining internal and external perimeter flanges. A longitudinal dividing plate is preferably in sealing abutment with the internal perimeter flange to define a first longitudinal duct for accommodating the flushing gas therein. The dividing plate defines at least one through orifice in fluid communication with the first duct, with the first duct in fluid communication with the inlet receiving the flushing gas.

A longitudinal covering plate is in sealing abutment with the external perimeter flange to define a second longitudinal duct, also for accommodating the flushing gas therein. The covering plate defines a plurality of through slits there-along that are in fluid communication with the second duct. The slits are preferably oriented on an angle in relation to a longitudinal outer edge of the plate to both preserve the structural integrity of the plate and to minimize the occurrence of a container's upper end catching on a slit while carried there-under on the conveyor. In a preferred embodiment, the through slits of the covering plate define a total predetermined cross sectional area that is greater than a total predetermined cross sectional area defined by the at least one through orifice of the dividing plate.

DESCRIPTION OF THE EMBODIMENTS

This invention relates generally to the distribution of a flushing gas during a packaging process. More specifically, the invention relates to a plenum for the distribution of a flushing gas that displaces an undesirable gas from a packaging container during such a process, the plenum optimizing the displacement of the undesirable gas within the container while also minimizing associated equipment costs and cleaning efforts.

Figure 1:
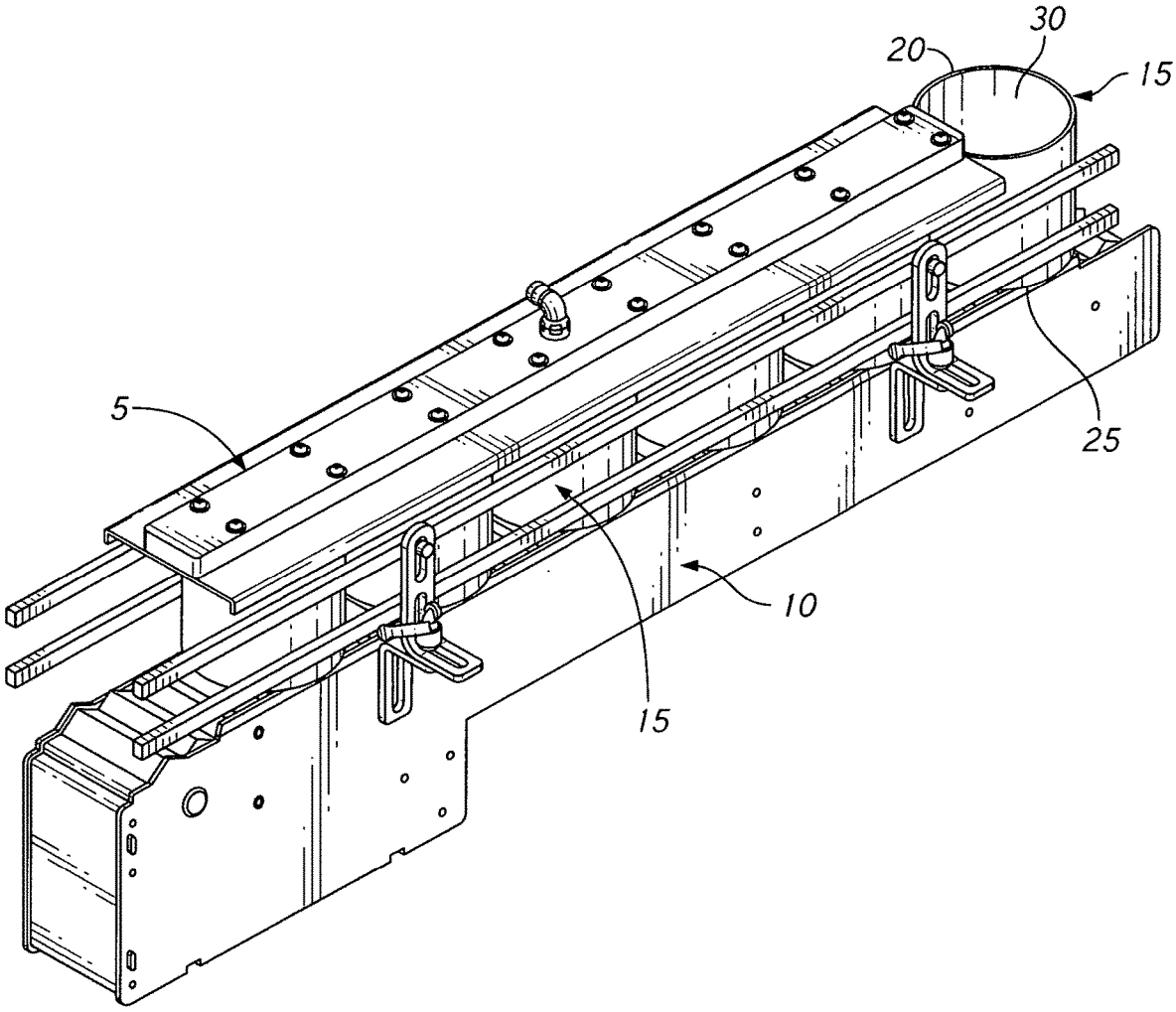
FIG. 1 is a perspective view of an embodiment of the plenum operably associated with a conveyor segment carrying containers for a filling and packaging operation.

Referring to FIG. 1 for context, plenum 5 is operably associated with a conveyor segment 10 configured for moving a plurality of containers 15 located thereon. Each container defines an open upper end 20 and closed lower end 25 to accommodate the placement of product within each container's interior 30. Plenum 5 is preferably located proximal to and above the containers' open upper ends 20 such that the plenum can flush the containers' interiors with a flushing gas 50, to be further discussed. The plenum 5 is preferably comprised of polished, stainless steel, aluminum or similar non-corrosive metals and/or alloys. However, it is understood that these components may be comprised of plastics and similar materials as well.

Although plenum 5 is illustrated within FIG. 1 as operably associated with conveyor 10 and containers 15 in a packaging environment, it is understood that plenum 5 may be used in other applications and processes as well, to include, without limitation, manufacturing processes, clean room environments, etc.

Thus, in one embodiment, the flushing gas 50 comprises carbon dioxide ($CO_2$) when it is desirable to prevent or inhibit the growth of microorganisms, such as certain molds and aerobic bacteria within the packaged product. In another embodiment, the flushing gas 50 comprises nitrogen ($N_2$) due to its inert qualities and its ability to prevent or inhibit an oxidation of the product. However, it is understood that yet other embodiments may utilize various combinations of these and/or other gases as well.

Figure 2:
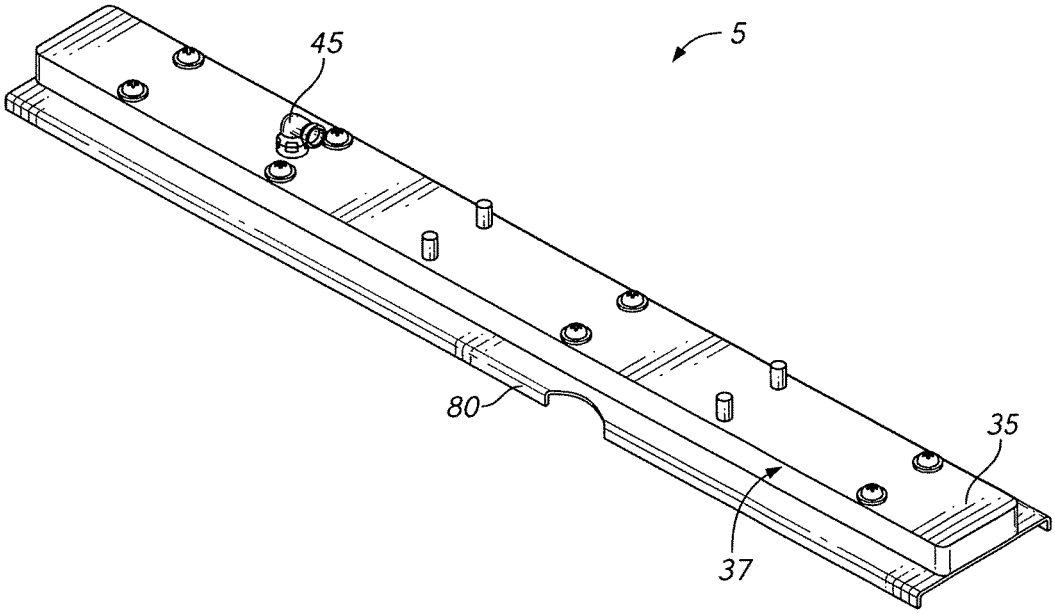
FIG. 2 is a perspective view of the plenum of FIG. 1.
Figure 2A:
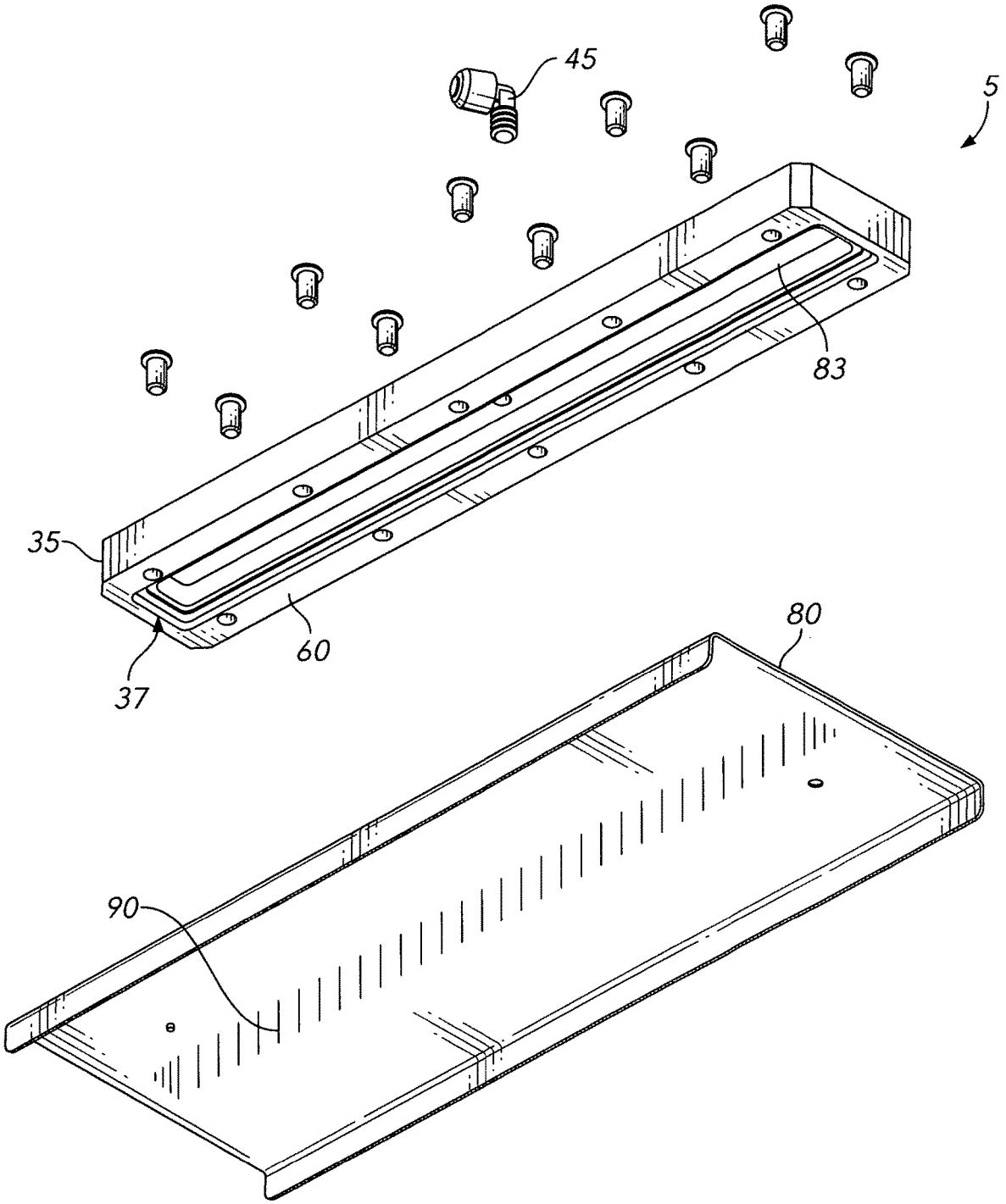
FIG. 2*a* illustrates upper and lower perspective assembly views of the plenum of FIG. 2 configured to provide a turbulent gas flow.
Figure 2B:
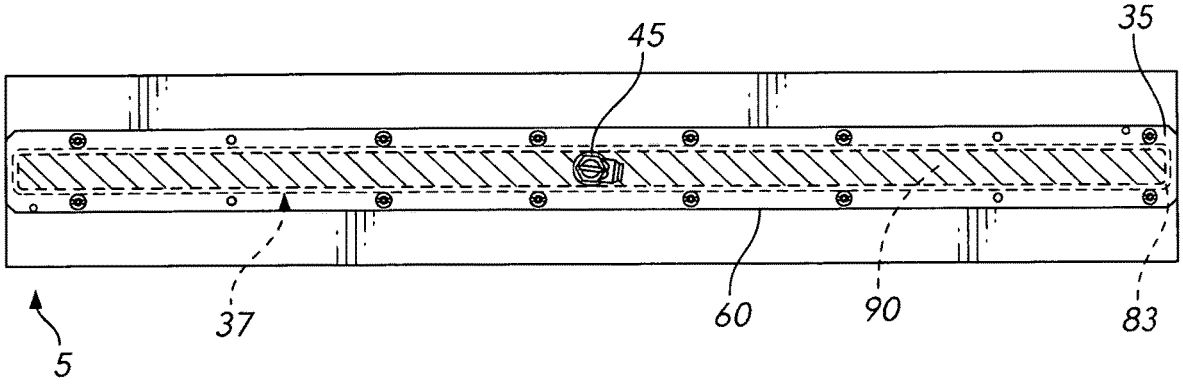
FIG. 2*b* is an upper plan view of the plenum of FIG. 2 illustrating the slots in hidden lines, the plenum configured to provide a turbulent gas flow.
Figure 3:
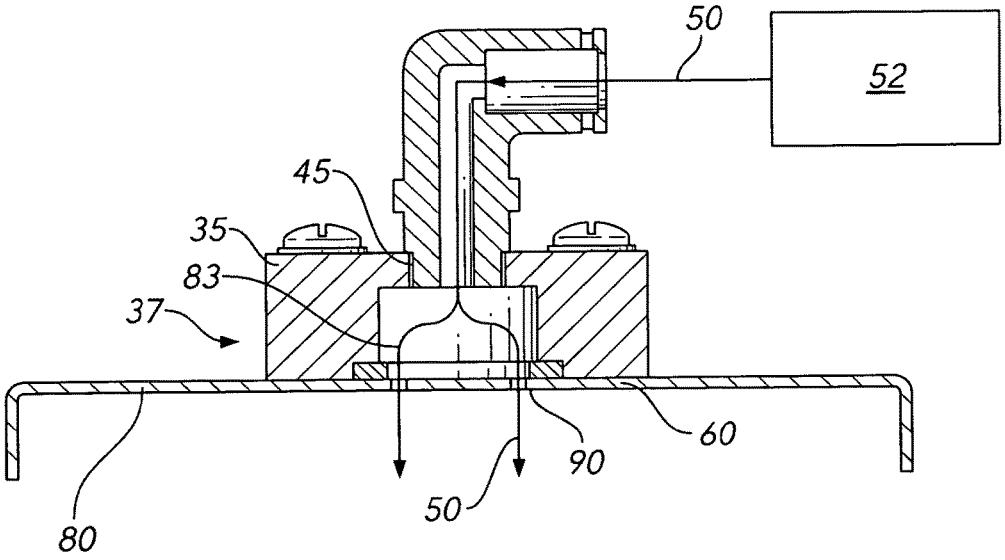
FIG. 3 is a sectional view of the plenum of FIG. 2 configured to provide a turbulent gas flow.
Figure 4:
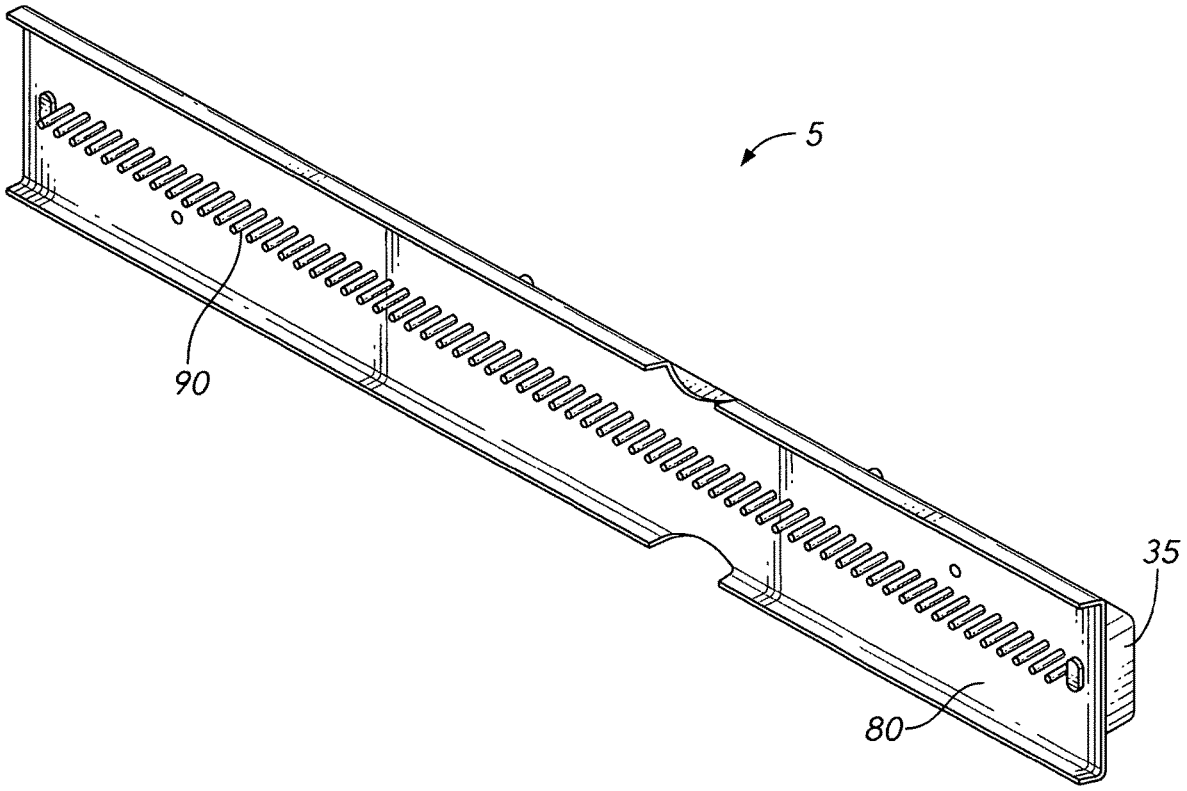
FIG. 4 is a perspective view of the plenum of FIG. 2 rotated to illustrate the covering plate and slits.
Figure 4A:
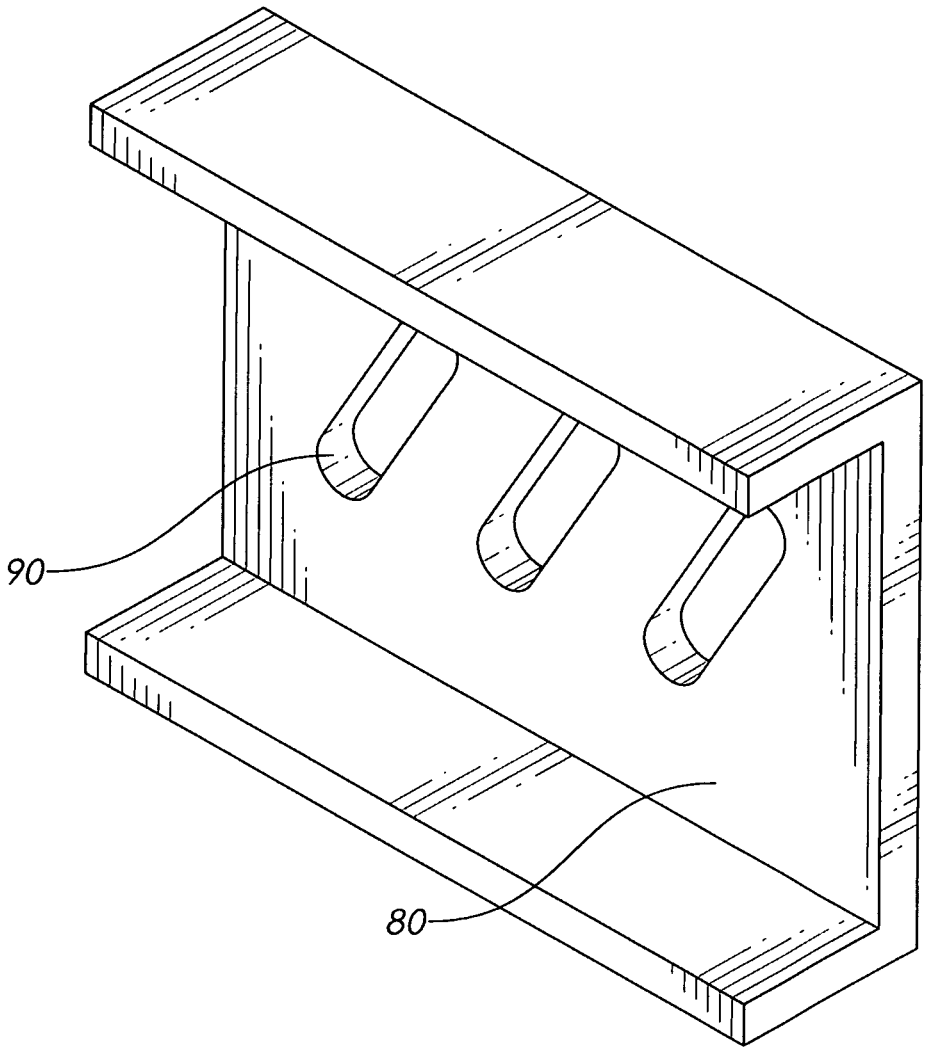
FIG. 4*a* is a section showing detail of slits of FIG. 4.

FIGS. 2 and 4 illustrate respective upper and lower perspective views of the plenum of FIG. 1 while FIGS. 2*a*, 2*b* and 3 illustrate perspective, assembly, plan and sectional views, respectively, of an embodiment of the plenum 5 configured to provide a turbulent flushing gas flow to the container. In this embodiment, plenum 5 preferably comprises a longitudinal manifold 35 defining a fillister 37 and an inlet 45 for receiving the flushing gas 50 from a pressurized gas source 52, the fillister defining an external perimeter flange 60.

Referring to FIG. 4 in addition to FIGS. 2, 2*a*, 2*b* and 3, a longitudinal covering plate 80 is in sealing abutment with the external perimeter flange 60 to define a longitudinal duct 83, for accommodating the flushing gas 50 therein. The duct preferably operates in the pressure of several inches of water. The covering plate 80 defines a plurality of through slits 90 there-along (FIG. 4) that are in fluid communication with the duct 83. The slits 90 are each about 0.010 inches wide by ⅜ of an inch long and preferably conform to a 35% orifice-to blank-length to evenly distribute the gas flowing there-though over a four foot section. The slits 90 are preferably oriented on an angle (i.e., between about 15 deg. and about 45 deg.) in relation to a longitudinal outer edge of the plate 80 to both preserve the structural integrity of the plate and to minimize the occurrence of a container's upper end catching on a slit while carried there-under on the conveyor.

Figure 5:
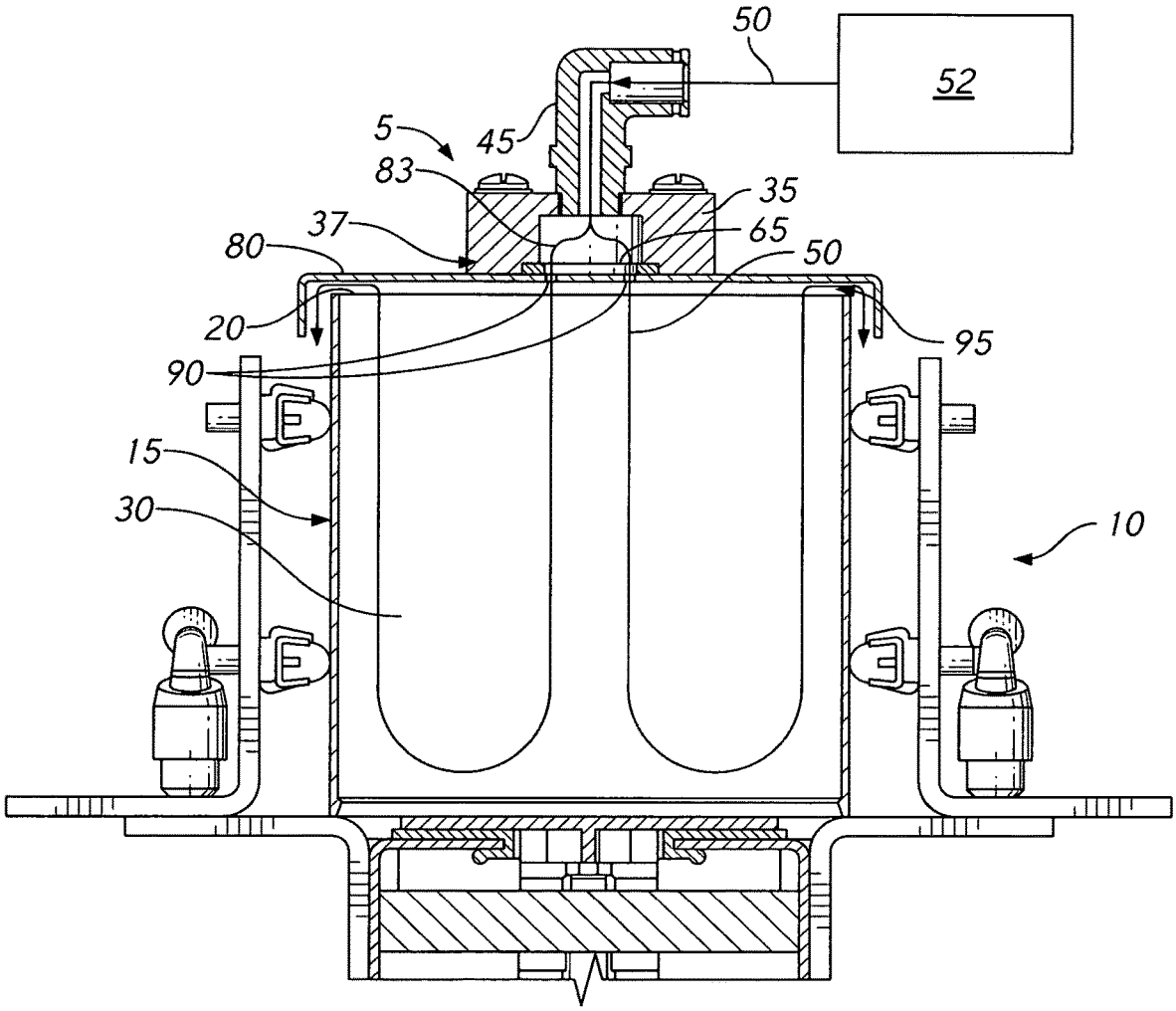
FIG. 5 is a sectional view of the plenum, conveyor segment and container of FIGS. 1 and 3 configured to provide a turbulent gas flow.

FIG. 5 illustrates a cross-sectional view of the plenum 5 of FIGS. 2*a*, 2*b*, and 3 in relation to a given container 15 located on the conveyor segment 10 of FIG. 1. This embodiment of the plenum provides a turbulent flushing gas flow to the container. The covering plate 80 of the plenum 5 is preferably located proximal to and above the container's open upper end 20 such that the plenum can flush the containers' interiors 30 with the flushing gas 50. The covering plate 80 is in about parallel relation with the container's open end 20 and preferably defines a width exceeding that of the open end such that the cover substantially covers the open end. The covering plate 80, however, is nonetheless displaced from the open end by a predetermined vertical distance 95 to allow gases, under the influence of the flushing gases 50, to exit the interior 30 of the container 15.

Prior to the container 15 moving along the conveyor segment 10 to a location beneath the plenum 5, undesirable atmospheric gases are typically present within the container's interior 30.

As previously discussed, such gases are undesirable because they contribute to the unwanted degradation of any contents to be later located within the container during the packaging process.

Referring again to FIG. 5, to facilitate the removal of such undesirable gases, the inlet 45 of the manifold 35 is connected in fluid communication with the pressurized flushing gas source 52. Under pressure, flushing gas 50 flows through the inlet 45 of the manifold and enters the duct 83. Upon achieving a predetermined pressure within the duct 83, the flushing gas flows though the plurality of slits 90 of the covering plate 80 and enters the interior 30 of the container located there-below.

The size of the slits 90 and their orientation and location along the covering plate 80 causes the flushing gas 50 to turbulently enter the interior 30 of the container 15 and mix with the undesirable gases present therein. The turbulent flow of the flushing gas 50 into the container 15 thus ensures both a complete mixture with the undesirable gases located therein and the complete, eventual displacement of the gas mixture therefrom until only the flushing gas itself remains present. The predetermined vertical distance 95 of the covering plate 80 from the upper open end 20 of the container 15, while allowing the undesirable gases to exit the container, also enables an adequate containment of the gas mixture within the container to ensure a complete mixture of the flushing with the undesirable gases for the eventual and complete displacement of the undesirable gases therefrom. The predetermined vertical distance 95 is preferably between about 1/16 in and about 1/4 in.

Figure 5A:
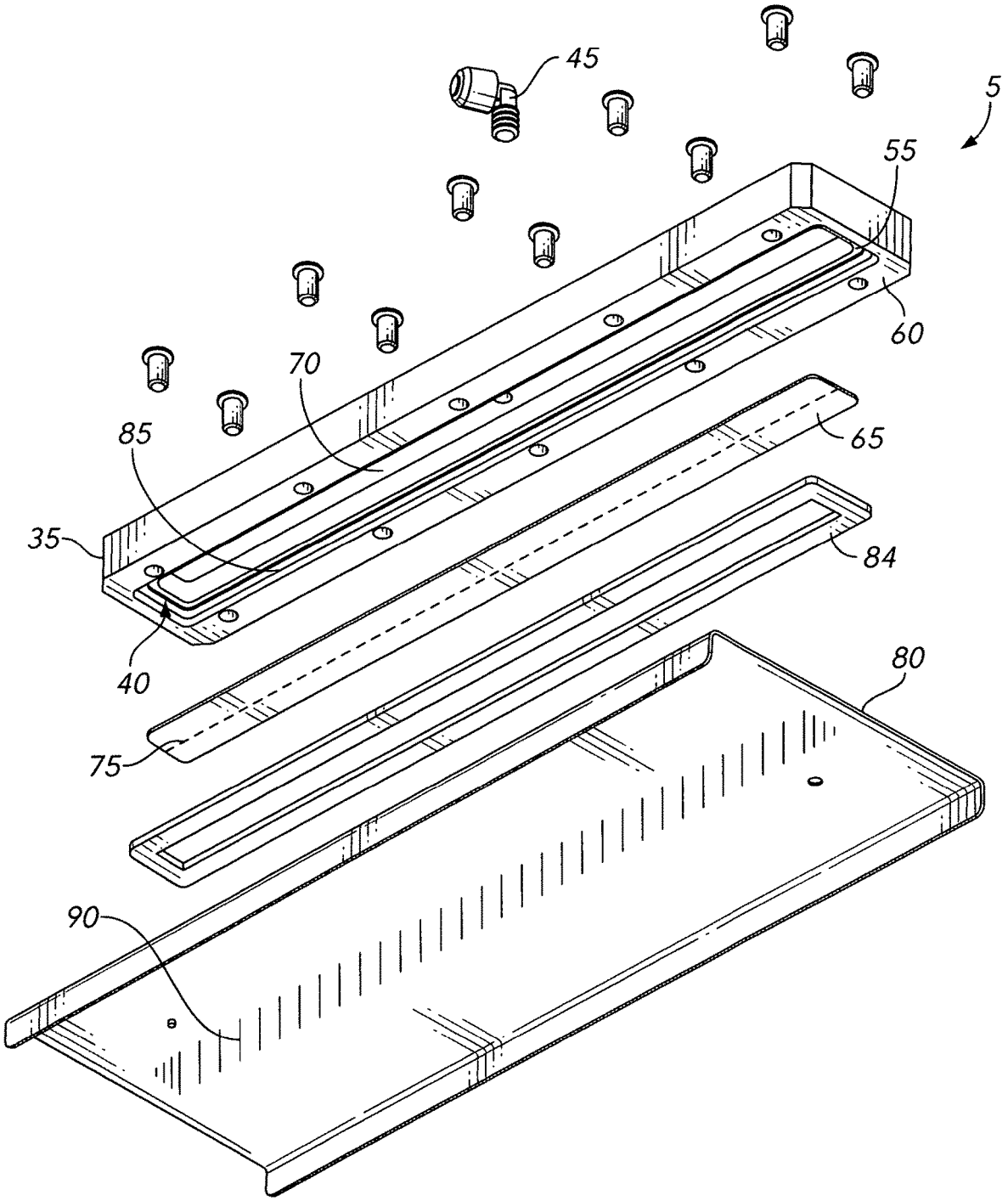
FIG. 5*a* illustrates upper and lower perspective assembly views of the plenum of FIG. 2 configured to provide a laminar gas flow.
Figure 5B:
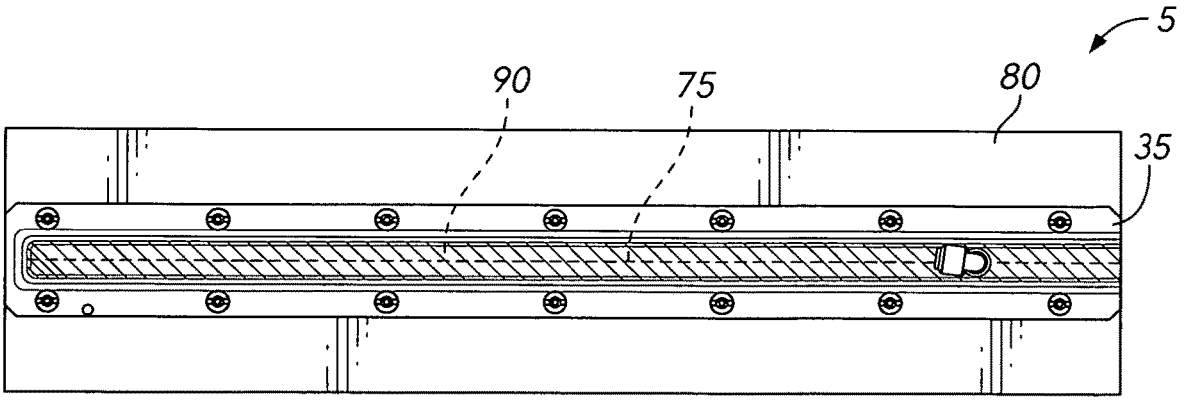
FIG. 5*b* is an upper plan view of the plenum of FIG. 2 illustrating the slots in hidden lines, the plenum configured to provide a laminar gas flow.
Figure 6:
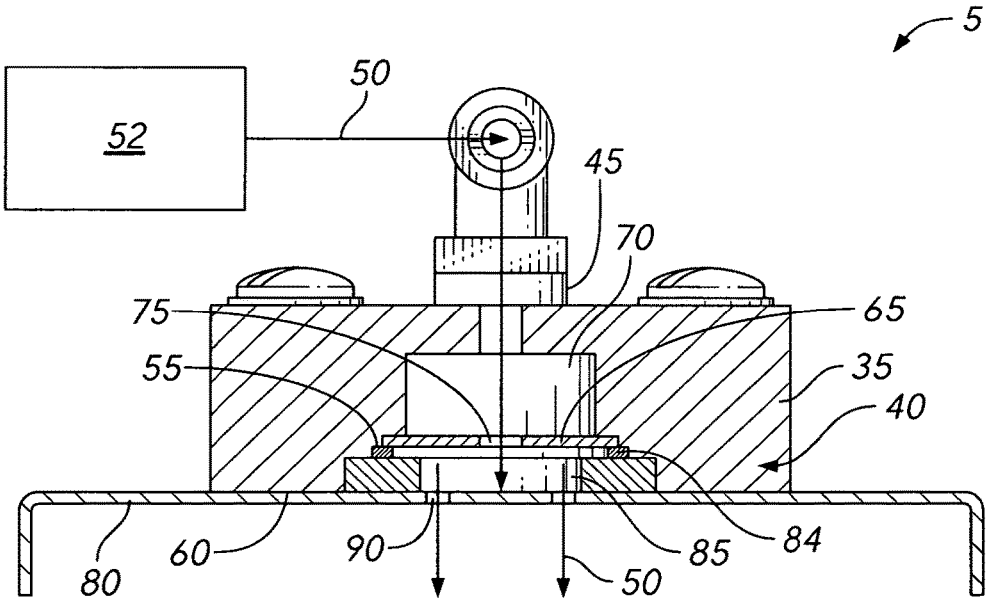
FIG. 6 is a sectional view of the plenum of FIG. 2 configured to provide a laminar gas flow.

FIGS. 5*a*, 5*b* and 6 illustrate perspective, assembly, plan and sectional views an embodiment of the plenum 5 of FIGS. 2 and 4 with the plenum configured to provide a laminar flushing gas flow to the container. In this embodiment, plenum 5 preferably comprises a longitudinal manifold 35 defining a stepped fillister 40 and an inlet 45 for receiving the flushing gas 50 from a pressurized gas source 52, the stepped fillister defining internal and external perimeter flanges 55 and 60. A longitudinal dividing plate 65 is preferably in sealing abutment with the internal perimeter flange 55 to define a first longitudinal duct 70 for accommodating the flushing gas 50 therein. The dividing plate 65 defines at least one through orifice 75 in fluid communication with the first duct 70, with the first duct in fluid communication with the inlet 45 receiving the flushing gas 50. The orifices 75 are each about 0.010 inches wide by 3/8 of an inch long and preferably conform to a 35% orifice-to blank-length to evenly distribute the gas flowing there-though over a four foot section.

Referring again to FIG. 4 in addition to FIGS. 2, 5*a*, 5*b* and 6, a longitudinal covering plate 80 is in sealing abutment with the external perimeter flange 60 to define a second longitudinal duct 85, also for accommodating the flushing gas 50 therein. A gasket 84 is optionally located between the plate covering 80 and internal flange 55 to hold the dividing plate 65 in place within the stepped fillister 40 such that the covering plate abuts the gasket, the gasket abuts the dividing plate, and the dividing plate abuts the internal flange. The covering plate 80 defines a plurality of through slits 90 there-along (FIG. 4) that are in fluid communication with the second duct 85. The slits 90 are each about 0.010 inches wide by 1% inches long and preferably conform to a 2.5% open area to blocked area ratio to evenly distribute the gas flowing there-though over a four foot section. The slits 90 are preferably oriented on an angle (i.e., between about 15 deg. and about 45 deg.) in relation to a longitudinal outer edge of the plate 80 to both preserve the structural integrity of the plate and to minimize the occurrence of a container's upper end catching on a slit while carried there-under on the conveyor. In a preferred embodiment, the through slits 90 of the covering plate 80 defining a total predetermined opening area that is greater than a total predetermined opening area defined by the at least one through orifice 75 of the dividing plate 65.

The disparate predetermined cross sectional orifice and slit areas thus define a flushing gas pressure differential between the respective first and second ducts 70 and 85, with the gas pressure of the first duct exceeding that of the second duct. Such pressures preferably range within inches of water pressure verses pound force per square inch for a significantly lower value. The high pressure duct preferably operates in the pressure of several inches of water.

Figure 7:
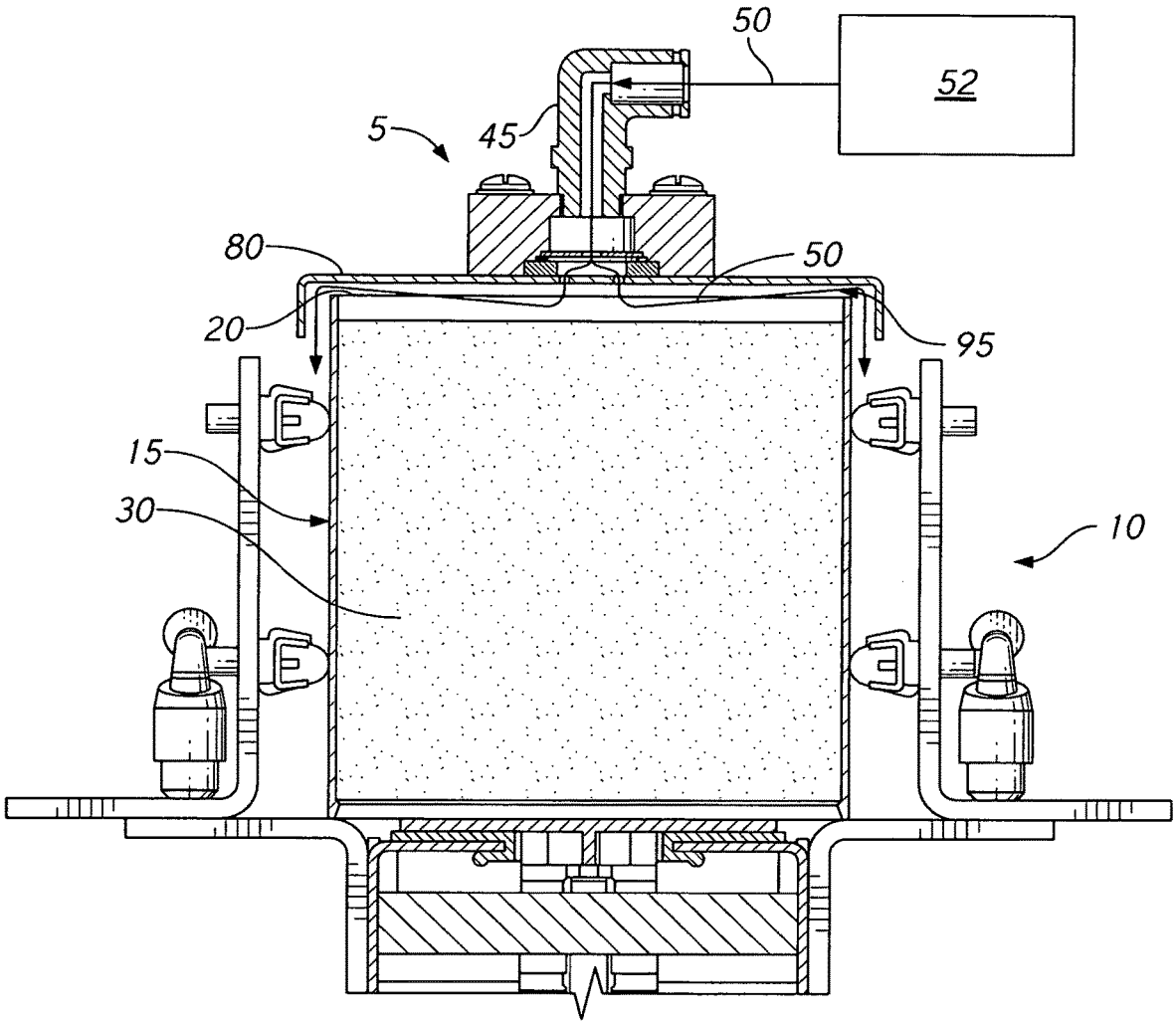
FIG. 7 is a sectional view of the plenum, conveyor segment and container of FIGS. 1 and 6 configured to provide a laminar gas flow.

FIG. 7 illustrates a cross-sectional view of the plenum 5 of FIGS. 5*a*, 5*b* and 6 in relation to a given container 15 located on the conveyor segment 10 of FIG. 1. This embodiment of the plenum provides a laminar flushing gas flow to the container. The covering plate 80 of the plenum 5 is preferably located proximal to and above the container's open upper end 20 such that the plenum can flush the containers' interiors 30 with the flushing gas 50. The covering plate 80 is in about parallel relation with the container's open end 20 and preferably defines a width exceeding that of the open end such that the cover substantially covers the open end. The covering plate 80, however, is nonetheless displaced from the open end by a predetermined vertical distance 95 to allow gases, under the influence of the flushing gases 50, to exit the interior 30 of the container 15.

Prior to the container 15 moving along the conveyor segment 10 to a location beneath the plenum 5, undesirable atmospheric gases are typically present within the container's interior 30, along with a predetermined quantity of product 100. As previously discussed, such gases are undesirable because they contribute to the unwanted degradation of the product located 100 therein. Referring again to FIG. 7, to facilitate the removal of such undesirable gases, the inlet 45 of the manifold 35 is connected in fluid communication with the pressurized flushing gas source 52. Under pressure, flushing gas 50 flows through the inlet 45 of the manifold and enters the first duct 70. Upon achieving a predetermined pressure within the first duct 70, the flushing gas flows though the at least one orifice 75 of the dividing plate 65 and enters the second duct 85. Upon achieving a predetermined pressure within the second duct 85, the flushing gas flows through the plurality of slits 90 of the covering plate 80 and enters the interior 30 of the container located there-below.

The size of the slits 90 and their orientation and location along the covering plate 80 causes the flushing gas 50 to laminarly enter the interior 30 of the container 15 and mix with the undesirable gases present therein. The laminar flow of the flushing gas 50 into the container 15 thus ensures both a complete mixture with the undesirable gases located therein and the complete, eventual displacement of the gas mixture therefrom until only the flushing gas itself remains present. The laminar flow of the flushing gas also ensures that the flow of the flushing gases into the container does not displace the product 100 (i.e., a granular product) from the container itself. The predetermined vertical distance 95 of the covering plate 80 from the upper open end 20 of the container 15, while allowing the undesirable gases to exit the container, also enables an adequate containment of the gas mixture within the container to ensure a complete mixture of the flushing with the undesirable gases for the eventual and complete displacement of the undesirable gases therefrom. The predetermined vertical distance 95 is preferably between about 1/16 in and about 1/4 in.

In use, a turbulent flow plenum as disclosed above is provided. A container having an open upper end is passed along a conveyor segment and beneath the plenum. A flushing gas is received by the plenum from a pressurized gas source and thereafter provided to the container, the gas directed into the container's interior to displace the undesirable gases therefrom. More specifically, the flushing gas received from the source flows through the inlet of the manifold and enters the duct. Upon achieving a predetermined pressure within the duct, the flushing gas flows though the plurality of slits of the covering plate, enters the interior of the container located there-below turbulently mixes with the undesirable gases present therein. The turbulent flow of the flushing gas into the container is continued until the eventual displacement of the undesirable gases from the container has occurred and only the flushing gas itself remains present.

In use, a laminar flow plenum as disclosed above is provided. A container having an open upper end and containing a predetermined quantity of product is passed along a conveyor segment and beneath the plenum. A flushing gas is received by the plenum from a pressurized gas source and thereafter provided to the container, the gas directed into the container's interior to displace the undesirable gases therefrom. More specifically, the flushing gas received from the source flows through the inlet of the manifold and enters the first duct. Upon achieving a predetermined pressure within the first duct, the flushing gas flows though the at least one orifice of the dividing plate and enters the second duct. Upon achieving a predetermined pressure within the second duct, the flushing gas flows through the plurality of slits of the covering plate, enters the interior of the container located there-below laminarly mixes with the undesirable gases present therein. The laminar flow of the flushing gas into the container, while not displacing the product therefrom, is continued until the eventual displacement of the undesirable gases from the container has occurred and only the flushing gas itself remains present.

While this foregoing description and accompanying figures are illustrative of the present invention, other variations in structure and method are possible without departing from the invention's spirit and scope.

I claim:

1. A plenum for distributing a flushing gas comprising:

a longitudinal manifold defining a fillister and an inlet for receiving the flushing gas, the fillister defining an external perimeter flange; and a longitudinal covering plate in sealing abutment with the external perimeter flange and defining a longitudinal duct, the covering plate defining a plurality of through slits there-along in fluid communication with the duct, the plurality of through slits oriented at an angle in relation to an outer edge of the covering plate, said duct in fluid communication with the inlet.

2. The plenum of claim 1 wherein the angle is between about 15 degrees and about 45 degrees.

3. The plenum of claim 2 wherein each through orifice is about 0.010 inches wide by 0.375 inches long.

4. The plenum of claim 2 wherein the plurality of through slits conform to a 35% orifice-to-blank length over a four foot section of the covering plate.

5. The plenum of claim 1 wherein the fillister is stepped, the stepped fillister defining internal and external perimeter flanges, the plenum further comprising a longitudinal dividing plate in sealing abutment with the internal perimeter flange and defining a first longitudinal duct, the dividing plate defining at least one through orifice in fluid communication with the first duct, said first duct in fluid communication with the inlet, and wherein the longitudinal covering plate in sealing abutment with the external perimeter flange defines a second longitudinal duct, the plurality of through slits in fluid communication with the second duct, the through slits of the covering plate defining a total opening area that is greater than a total opening area defined by the at least one through orifice of the dividing plate.

6. The plenum of claim 5 wherein the angle is between about 15 degrees and about 45 degrees.

7. The plenum of claim 6 wherein the at least one through orifice of the dividing plate comprises a plurality of through orifices.

8. The plenum of claim 7 wherein the plurality of through orifices conform to a 35% orifice-to-blank length over a four foot section of the dividing plate and the through slits conform to a 2.5% open area to blocked area ratio over a four foot section of the covering plate.

9. The plenum of claim 7 wherein a ratio of the opening area of the plurality of through orifices to the opening area of the plurality of through slits defines a pressure of the flushing gas within the first longitudinal duct that exceeds a pressure of the flushing gas within in the second longitudinal duct.

10. The plenum of claim 7 wherein each through orifice is about 0.010 inches wide by 0.375 inches long.

11. The plenum of claim 10 wherein each through slit is about 0.010 inches wide by 1.5 inches long.

12. A method of displacing undesirable gases from an empty container the method comprising:

providing a plenum, a flushing gas and the empty container;

moving the flushing gas through an inlet of a manifold of the plenum from a gas source and into a duct of a plenum; and moving the flushing gas through a plurality of slits of a covering plate of the plenum from the duct and into an open end of the empty container, the plurality of through slits oriented at an angle in relation to an outer edge of the covering plate, the flushing gases displacing the undesirable gases from the container.

13. The method of claim 12 wherein the angle is between about 15 degrees and about 45 degrees.

14. The method of claim 13 wherein each through slit is about 0.010 inches wide by 0.375 inches long.

15. A method of claim 12 wherein the empty container has a product therein and wherein the duct of the plenum comprises a first duct of a plenum, the method further comprising moving the flushing gas though at least one orifice of a dividing plate of the plenum from the first duct and into a second duct of the plenum, wherein moving the flushing gas through a plurality of slits of a covering plate of the plenum from the duct and into an open end of the empty container comprises moving the flushing gas through a plurality of slits of a covering plate of the plenum from the second duct and into an open end of the container having the product therein, and wherein the through slits of the covering plate defining a total opening area that is greater than a total opening area defined by the at least one through orifice of the dividing plate.

16. The method of claim 15 wherein the angle is between about 15 degrees and about 45 degrees.

17. The method of claim 16 wherein the at least one through orifice of the dividing plate comprises a plurality of through orifices.

18. The method of claim 17 wherein a ratio of the opening area of the plurality of through orifices to the opening area of the plurality of through slits defines a pressure of the flushing gas within the first longitudinal duct that exceeds a pressure of the flushing gas within in the second longitudinal duct.

19. The method of claim 17 wherein each through orifice is about 0.010 inches wide by 0.375 inches long.

20. The method of claim 19 wherein each through slit is about 0.010 inches wide by 1.5 inches long.

* * * * *